US005799329A

United States Patent [19]

Hauschild

[11] Patent Number: 5,799,329

[45] Date of Patent: Sep. 1, 1998

[54] SPORT UTILITY CASE CONVERTIBLE VEST

[76] Inventor: Alan D. Hauschild, 24908 W. Fox Trail, Lake Villa, Ill. 60046

[21] Appl. No.: 584,407

[22] Filed: Jan. 11, 1996

[51] Int. Cl.[6] ..... A41D 1/04

[52] U.S. Cl. ..... 2/102; 2/69; 383/4

[58] Field of Search ..... 2/102, 94, 108, 2/2, 2.5, 69, 69.5, 115, 243.1, 455, 456, 457; 224/584; 383/4; 190/1

[56] References Cited

U.S. PATENT DOCUMENTS

| | | | |
|---|---|---|---|
| 3,266,070 | 8/1966 | O'Link | 2/102 |
| 4,475,247 | 10/1984 | Lee | 2/94 |
| 4,637,076 | 1/1987 | Tartt et al. | 2/102 |
| 4,998,654 | 3/1991 | Bruzek et al. | 2/102 |
| 5,014,359 | 5/1991 | Hanson | 2/102 |
| 5,031,733 | 7/1991 | Chang | 2/102 |
| 5,075,900 | 12/1991 | Chittenden | 2/94 |
| 5,331,683 | 7/1994 | Stone et al. | 2/102 |
| 5,361,412 | 11/1994 | Perry | 2/102 |
| 5,370,113 | 12/1994 | Parsons | 2/102 |

*Primary Examiner*—Gloria Hale
*Attorney, Agent, or Firm*—Ladas & Parry

[57] ABSTRACT

A sports utility case which is convertible to a vest and designed to carry elongated sporting objects of every description is disclosed. Several embodiments are contemplated including the incorporation of bullet-resistant fabrics as well as buoyancy means. Multiple layer construction facilitates the easy insertion of different materials between inner and outer surface sides depending on the use contemplated.

13 Claims, 2 Drawing Sheets

SPORT UTILITY CASE CONVERTIBLE VEST

BACKGROUND OF THE INVENTION

The present invention relates to a sport utility case which is convertible to a vest, more particularly a sport utility case for elongated objects such as rifles, shotguns, bows including long bows, and compound bows, fishing rods, skis, snow boards and the like which has at least one zipper or other fastening means around a substantial portion of the outside periphery and a series of other standard fastening or securing means such as D-type clips, with belts, hook and loop, fasteners commonly sold under the trademark "VELCRO" or the like for securing the vest on the body of the wearer. A number of embodiments are disclosed including high visibility materials, camouflage, bullet resistant and means for buoyancy being built into the sport utility case/vest either alone or in combination. (For the sake of brevity the convertible sport utility case will be referred to hereinafter as "the case/vest".)

Cases for carrying sporting items have traditionally been made in conformity with the shape of the items to be placed therein. For example gun cases for rifles and shotguns are generally long planar devices which are straight with an enlarged portion for placement of the stock of the gun and a narrower elongated portion reflecting the part of the case where the barrel would be placed. An example of such case is disclosed in U.S. Pat. No. 3,437,247 to Gantress.

Cases for storage of sporting items such as rifles or shotguns have been provided which additionally serve an alternative purpose when the rifle or shotgun is removed. Attempts have been made hithertofore to provide gun cases which are convertible into a vest including anti-ballistic properties at least as preferred embodiments. For example, U.S. Pat. No. 4,475,247 to Lee discloses a combination gun case and protective apparel having bullet resistant material integrally formed as part of the gun case or as an insert within the gun case. Essentially the gun case has a periphery zipper which extends only over little more then half of the outside perimeter of the case. When unzipped, the gun case is attachably mounted to the wearer in such a manner that the case covers only the front torso of the wearer with the two ends that were formerly zippered together being opposed and disposed on the respective right and left sides of the wearer. A series of belts are then required to secure the vest.

U.S. Pat. No. 5,031,733 discloses a suitcase which is convertible to a vest. Multiple hinged joints which are disposed on the sides of the case come undone yielding a planar device which is placed over the head and loosely secured by having two of the hinged joints attached over the wearer's shoulders. Bullet resistant material is disclosed in one embodiment for use in each of the plate members rendering protective properties for the wearer.

Each of these devices is deficient in the sense that the protective apparel of the former is rather cumbersome in that the entire front torso is covered through the groin and hip area and descends to the knees. Clearly the mobility of the wearer is hampered however, more importantly, the back is not protected at all.

The suitcase/vest of the latter while providing plates covering the front and back of the wearer only provides means for securing the device over each shoulder yielding a vest where an entire side of the wearer is inadequately or totally unsecured.

Problems of immobility and not having a vest securely placed on the wearer are commonplace in the prior art.

Additionally, problems associated with designs to convert straight line gun cases or other sport utility cases vests or other wearable garments is restricted in the sense that the design of the case, reflective of the design of the sporting item necessarily dictates the design limitations of the vest or other garment. Attempts have been made by the Applicant to design linearly straight gun cases such as those disclosed in the U.S. Pat. No. 3,437,247 with modifications for conversion into a wearable garment such as a vest.

Design limitations have resulted in a case/vest which while serving as an adequate storage and transport case is deficient as a wearable garment such as a vest. The deficiencies are directly attributable to the essentially linear design of the case which is reflective of the sporting item or article which is to be placed in the case. In the instance where it is desirable to have the case converted into a vest, the straight linear configuration limits the total area of the body to be covered. Accordingly, there is a need for an improved sport utility case which may be converted into a vest which can cover a substantial area of the wearer and remain securely placed on the wearer.

The present invention addresses and overcomes many of the deficiencies of the prior art by providing a sports utility case which is readily convertible into a vest having a back portion and two front portions.

The present invention provides a sports utility case convertible to a vest, said case being defined by a top curvilinear portion angularly disposed and having a first and second liner portion connectably attached to each other by a concave portion;

The present invention further provides a sports utility case convertible to a vest comprising;

one square panel, and a first and second rectangular panel, said first and second rectangular panels having opposing outer and inner peripheral edges and being interconnected through a concave juncture such that they form the branches of a "Y" and extend away from each other; said square panel corresponding to the stem of the "Y" and having by two opposing parallel sides and a bottom, each of the opposing parallel sides having a top and bottom wherein the bottom of each parallel opposing side terminates at a juncture with the bottom of the square panel, the top of each parallel opposing side terminating in a concave juncture attachably joining one of each of said rectangular panels.

Pliable materials used in the construction of the case/vest allow the user easy mobility. The unique "boomerang" design allows for a vest which can substantially cover the front and back of the wearer with adjustable securing means disposed on the sides of the vest to allow for a contouring fit. A further securing means such as a zipper is provided at the front of the vest which functions essentially as a jacket zipper serving to completely secure the vest to the wearer.

SUMMARY OF THE INVENTION

The invention relates to a sports utility case for elongated objects such as rifles, shotguns, bows including long bows and compound bows, fishing rods, skis, snow boards, and the like which can be used for carrying these items into the area for their use, or simply for long and short term storage and transport. When the sports utility item is removed from the case, the fastening means which includes at least one zipper which substantially surrounds the perimeter of the device is fully undone allowing the case to be readily converted into a vest and immediately wearable. Securing means or fastening means such as clips, hooks, belts or fasteners commonly sold under the trademark "VELCRO" which are dispersed along the length of the case/vest are used to secure the case converted into the vest to the wearer.

At least one zipper or other securing means substantially surrounds the outer portion of the perimeter of the sports utility case when it is a single unitary piece. Upon removal of the item from the case, the zipper or securing means is fully released or undone along the entirety of its length yielding a single piece with three distinct sections. These sections constitute an essentially square piece which serves as the back portion of the vest and two lobes which extend forward and in opposing outward directions from the square back portion. The outward portions form the front breast pieces or plates of the vest when placed on the wearer.

Securing means are disposed along the length of the vest/case which are in the form of clips, hooks, belts or straps having ends with fastening material commonly sold under the trademark "VELCRO". Their primary function is to serve as securing means for keeping the vest secured to the wearer by connecting the sides of back plate to the respective adjacent breast plate portions. Further, securing means are provided which allow for the two breast plates to be fastened together across the front of the wearer. These means in a preferred embodiment are a portion of the zipper length which has been undone as described hereinabove.

The sports utility case convertible vest has many embodiments and variations which can make it an ideal device for several uses including recreational hunting. Blaze orange or fluorescent orange coloring on the outside of the case can add to the safety of the wearer when in the field. As both front breast plates cover a substantial portion of the front of the wearer as well as the back being substantially covered by the back plate, visibility to fellow hunters is greatly increased. Camouflage may also be desirable for some hunters as well as other colors which can allow the wearer to blend into any topography.

Additional embodiments include the ability of the sport utility case convertible vest to accommodate shell holders in the instance of use for hunting. Shell holders can be either made part of the case/vest or a modular attachable means secured to the case by belts, straps, fasteners commonly sold under the trademark "VELCRO" etc.

In a similar light, the sport utility case/vest can be used for trap shooting as padded shoulders and shell holders are essential to this sport. Padded shoulders can be sewn into the case/vest or integrally formed therein as shock absorbers.

The ability to incorporate bullet resistant material commonly sold under the trademark "KEVLAR" into the structure of the case/vest will be useful for hunting and sport applications as well as in the area of law enforcement.

Hunting accidents are relatively common occurrences where a number of hunters are seeking game in limited area and a fellow hunter is mistaken for game. In this instance, the vest form of the case can provide a means of protection for the hunter through the incorporation of bullet resistant fabric within the structure of the vest.

For example, the inside portion of the case/vest or inner surface side should be comprised of an inner liner which being material which is soft and yet durable to accommodate the rifle, shot gun, bow or other article while not allowing this article to be scratched during insertion, removal, storage or transportation. Further, the material of this inner liner must be durable for use as a vest as this inner surface side portion of the case/vest will be in constant contact with the user when the case is converted into a vest. The constant rubbing of the vest against the wearer or his clothes should not compromise the ability of this inner liner not to scratch the gun when reinserted into the case. Materials contemplated include both natural and synthetic materials which are soft to the touch and scratch resistant. If warmth is a factor in the use of the case/vest, lamb wool, fleece or the like may be included as part of the inner liner.

The outer surface should be comprised of a durable tightly woven fabric in order to resist any rips or tears in the instance of storage or transport when the gun is inserted in the case. Tightly knit fabrics must be pliable and preferably water resistant in addition to durable. Fabrics contemplated include cottons, waxed cottons, rayons, polyesters and any other materials which can provide durability, pliability and water resistance either naturally or through treatments.

The outer surface material must be able to withstand the rigorous elements often associated with hunting as well as sport shooting, skiing and general recreation. Tears are commonly associated with getting clothing or gear caught on fences, shrubbery, tree branches, etc. The durability of the outer surface material is necessary in order to help protect both the item in the case as well as the wearer. In a preferred embodiment, as mentioned above, the outer surface material is also water proof or water resistant. A number of materials for different purposes may be included between the inner liner and the outer surface layer depending of course upon the contemplated use of the case/vest.

A layer of insulating material or padding may be placed between these layers which can add bulk, shock resistance and warmth. When use as a gun case, the insulation may serve to absorb shocks normally associated with the storage and transportation of guns. In the vest form, the insulation in the vest may serve as a further layer of clothing to keep the wearer warm.

A bullet-resistant fabric such as commonly sold under the trademark "KEVLAR" or the like may be fitted between the inner and outer surface layers to render the vest resistant to bullets, shot or other projectiles. Similarly, law enforcement officers would necessarily want to have the case when converted into and worn as a vest, offer them protection. This bullet resistant fabric embodiment is not however limited to hunting and law enforcement as utility for a bullet resistant gun case which is convertible into a vest would find tremendous utility for military applications. Regular ground forces as well as Special Forces units including snipers would find utility in the convertible case/vest as described herein.

Other embodiments which may be provided between the inner and outer surface adding to the utility of the sports utility case/vest include inflatable bladders or floatable polymeric material which could serve as buoyancy devices. As a major segment of the game hunters include those who seek water foul, the danger of being in close proximity to or actually on water is ever present. Due to the excess weight and bulk of standard hunting clothing including boots, the addition of an inflatable case/vest to the hunter's wardrobe could heighten the safety of the sport.

The case/vest lends itself for ready adaptation from the basic embodiments already disclosed. For example further attachable means such as buttons, clips, zippers or the like may be included in the concave portion between the two rectangular breast plates in order to facilitate the securing of a hood or similar device to the case/vest when it is converted to a vest.

The structure of the case/vest is readily adaptable for easy application in both long and short distance carrying by providing a handle or shoulder strap attached for ease in carrying the case when loaded. A shoulder strap can be attached to the case/vest to assist the user in carrying the loaded case over long distances.

DETAILED DESCRIPTION OF THE PREFERRED EMBODIMENTS

Figure 1:
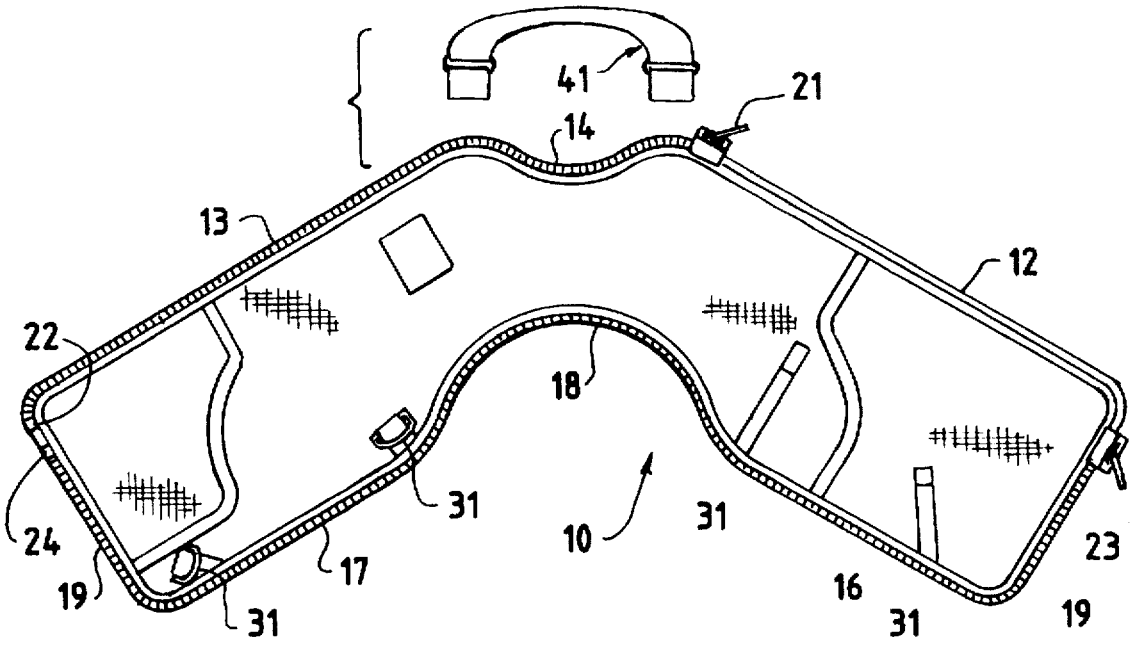
FIG. 1 shows one surface side of the case/vest in its closed configuration.

Referring to FIG. 1, a first embodiment of the sport utility case convertible to a vest is disclosed showing one side view of the device generally indicated as 10. The generally angular or boomerang shape of the case/vest shown disclosed as the top curvilinear surface with the first linear portion 12 and the second linear portion 13 connectably attached by concave portion 14. The bottom curvilinear portion is comprised of the bottom first linear portion 16 and the bottom second linear portion 17 connected by bottom concave portion 18. End portions 19 are also shown. Top zipper means 21 is shown terminating at a top zipper terminus 22. A bottom zipper means 23 is disclosed at one end portion 19 and extending along the entire bottom curvilinear portion through the bottom first linear portion 16, the bottom concave portion 18, the bottom linear portion 17 cross the other end portion 19 and terminating at bottom zipper terminus 24, which is adjacent to top zipper terminus 22. Securing means 31 are shown in a preferred embodiment with "D" hooks shown along the bottom second linear portion 17 and elongated straps shown along bottom first linear portion 16. Handle means 41 is provided in a preferred embodiment for carrying said case/vest 10.

Figure 2:
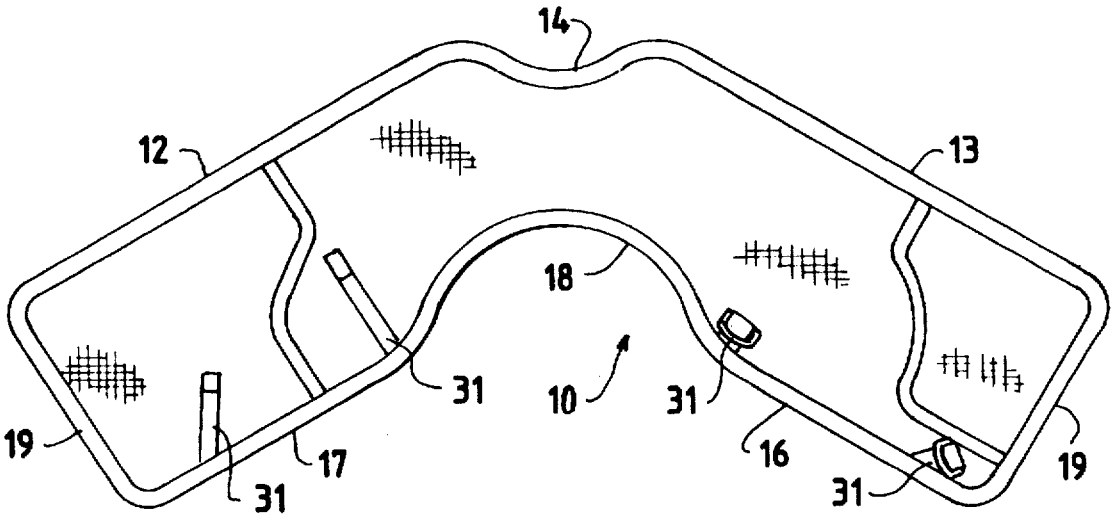
FIG. 2 shows the reverse side of the case vest in its closed configuration.

FIG. 2 shows the reverse side view of the case/vest with top concave portion 14 and bottom concave portion 18 as well as first top linear portion 12 and second top linear portion 13 and bottom first and second linear portions 16 and 17 respectively the "D" hook securing means 31 are shown along bottom first linear portion 16 with the strap embodiments for the securing means shown along the bottom second linear portion 17.

Figure 3:
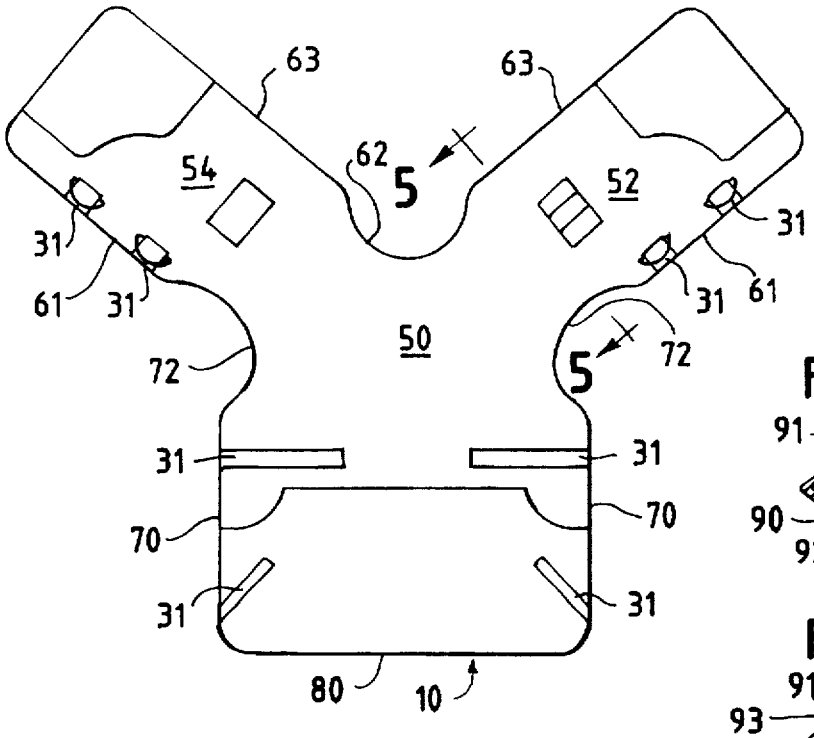
FIG. 3 shows a planar view of the case unfastened with the back panel and the two breast plates shown.

FIG. 3 shows the case/vest 10 with square panel 50 attached to first rectangular panel 54 and second rectangular panel 52 through means of concave junctions 72 meeting the parallel opposing sides 70 of the square panel 50. Concave juncture 62 connectably attaches the inner peripheral surface sides of the first and second rectangular panels 52 and 54 respectively. The outside peripheral surface side 61 of the respective first and second rectangular panels 52 and 54 show securing means 31 which attach to the adjacent securing means 31 displaced on square panel 50 along the parallel opposing sides 70.

Figure 5A:
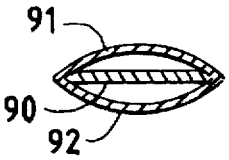
FIG. 5*a* shows a view of a detail of construction taken on line 5—5 of FIG. 3 as indicated which shows bullet resistant fabric between the outer shell and inner liner of the sports utility case.
Figure 5B:
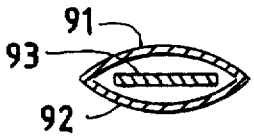
FIG. 5*b* shows a view of a detail of construction taken on line 5—5 of FIG. 3 as indicated which shows floatable means between the outer shell and inner liner of the sports utility case.
Figure 4:
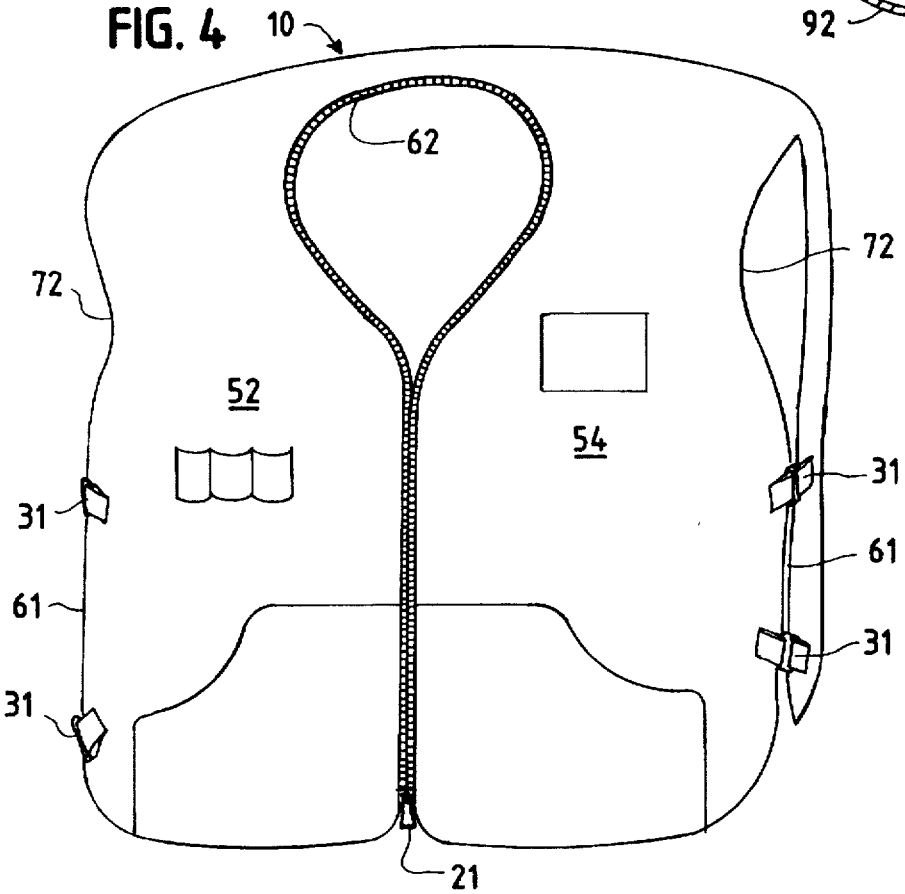
FIG. 4 shows the case converted into a vest with the zipper and securing means attached.

The vest/case 10 as disclosed in FIG. 4 shows the case converted into the vest with first and second rectangular panels 52 and 54 respectively being attachably connected by zipper means 21 and forming collar 62 which resulted from the concave juncture 62 connecting rectangular panels 52 and 54. The concave junctures 72 are shown when the case is converted into the vest as resulting in armholes with securing means being attached at points 31 along the outer peripheral sides 61 of the vest 10. FIG. 5*a* shows a view of a detail of construction taken on line 5—5 of FIG. 3 as indicated which shows bullet resistant fabric 90 between the outer shell 91 and inner liner 92 of the sports utility case. FIG. 5*b* shows a view of a detail of construction taken on line 5—5 of FIG. 3 as indicated which shows floatable means 93 between the outer shell 91 and inner liner 92 of the sports utility case.

Having disclosed my invention I claim as follows:

1. A sports utility case convertible to a vest comprising:

an outer shell having one square panel, and a first and second rectangular panel, said first and second rectangular panels having opposing outer and inner peripheral edges and being interconnected through a concave juncture such that they form the branches of a "Y" and extend away from each other, said square panel corresponding to the stem of the "Y" and having two opposing parallel sides and a bottom, each of the opposing parallel sides having a top and bottom wherein the bottom of each parallel opposing side terminates at a juncture with the bottom of the square panel, the top of each parallel opposing side terminating in a concave juncture attachably joining one of each of said rectangular panels;

releasable means, extending along at least part of the outer and inner peripheral edges of the first aid second rectangular panels, the concave junctures joining each rectangular panel and the square panel, and the parallel sides and bottom of the square panel, for securing the outer shell in a folded position to define a compartment for an elongated object; and securing means attached adjacent the opposing sides of the square panel and adjacent the outer peripheral edges of the rectangular panels for positioning each one of the opposing sides of the square panel adjacent one of the outer peripheral edges of the rectangular panels so as to define a vest conforming to the body of a wearer.

2. The sports utility case of claim 1 wherein the releasable means includes at least one zipper.

3. The sports utility case of claim 1 wherein the securing means is selected from zippers, clips, hooks, belts, and hook and loop devices.

4. The sports utility case of claim 1 wherein an attachable means is provided adjacent the inner peripheral edges of the first and second rectangular panels so that the panels can be attachably secured to each other.

5. The sports utility case of claim 4 wherein the attachable means is selected from zippers, clips, hooks, belts, and hook and loop devices.

6. The sports utility case of claim 1 wherein the concave juncture between the rectangular panels forms a collar when the case is converted into a vest.

7. The sports utility case of claim 1 wherein the concave junctures joining the parallel opposing sides of the square panel and the first and second rectangular panels form arm holes when the case is converted into a vest.

8. The sports utility case of claim 1 wherein the case has a boomerang shape when the outer shell is secured in a folded position.

9. The sports utility case of claim 1 further comprising an inner liner secured to the outer shell.

10. The sports utility case of claim 9 wherein bullet resistant fabric is included between the outer shell and inner liner.

11. The sports utility case of claim 9 wherein floatable means such as inflatable bladders or floatably polymeric materials are included between the outer shell and inner liner.

12. The sports utility case of claim 9 wherein the outer shell comprises high visibility fabric and the inner liner comprises soft, scratch resistant fabric.

13. The sports utility case of claim 9 wherein the outer shell fabric is water-resistant.

* * * * *